United States Patent [19]

Sauerbruch

[11] Patent Number: 4,555,891

[45] Date of Patent: Dec. 3, 1985

[54] APPARATUS FOR FITTING TOGETHER CUP-LIKE CONTAINERS AND PACKAGING CARRIERS WHICH ENGAGE SAME

[76] Inventor: Ernst F. Sauerbruch, Gewerbestrasse 31, D-7702 Gottmadingen, Fed. Rep. of Germany

[21] Appl. No.: 543,022

[22] Filed: Oct. 18, 1983

[30] Foreign Application Priority Data

Oct. 19, 1982 [DE] Fed. Rep. of Germany ..... 3238698

[51] Int. Cl.[4] ..... B65B 27/04

[52] U.S. Cl. ..... 53/48; 53/147

[58] Field of Search ..... 53/48, 443, 147

[56] References Cited

U.S. PATENT DOCUMENTS

| | | | |
|---|---|---|---|
| 3,032,943 | 5/1962 | Reimers et al. | 53/48 |
| 3,162,988 | 12/1964 | Sherman | 53/48 |
| 3,285,410 | 11/1966 | Brunsing | 53/48 U X |
| 3,325,966 | 6/1967 | Bruce et al. | 53/48 X |
| 3,383,827 | 5/1968 | Schaich | 53/48 X |
| 4,324,085 | 4/1982 | Olsen | 53/48 |

*Primary Examiner*—James F. Coan

*Attorney, Agent, or Firm*—Bachman & LaPointe

[57] ABSTRACT

In an apparatus for fitting together cup-like or pot-like containers and packaging carriers which engage same and which are supplied by a guide means to the containers which are carried by a conveyor member, to form a packaging unit, the invention seeks to make it possible for the assembly operation to be performed by machine with a high level of through-put capacity and a wide capacity for adaptation to different sizes and quantities of containers or groups of containers.

For that purpose, at least one holder means (20) which temporarily receives the containers (1) which are intended for a packaging carrier (3), from the conveyor member (13), is disposed movably above the conveyor member (13), the substantially horizontal path of movement of the holder means extending between an array of pressure members (60) and abutment members (31), disposed downstream of the guide means (26) for the packaging carriers and forming a pressing station (25), said path of movement downstream of said array touching a discharge conveyor. The operation of supplying the containers (1) and also the operation of removing the packaging unit (1, 3) can be carried out by a single conveyor member (13) which extends beneath the path of movement of the holder means.

22 Claims, 10 Drawing Figures

APPARATUS FOR FITTING TOGETHER CUP-LIKE CONTAINERS AND PACKAGING CARRIERS WHICH ENGAGE SAME

BACKGROUND OF THE INVENTION

The present invention relates to an apparatus for fitting together cup-like containers and packaging carriers which engage same and which are supplied by a guide means to the containers which are carried by a conveyor member.

A machine for assembling containers and carriers is disclosed in U.S. Pat. No. 3,032,943. That machine has a rotor, by means of which a film or foil is applied to pots or containers which must be gripped by shoes or jaws, in which case they may possibly suffer from deformation.

DE-OS (German laid-open application) No. 23 04 561 provides that the film or foil is fed from a reel-like guide means to two coaxial discs on which the film or foil is joined to the containers which are supplied between stationary guide rails, acting as conveyor members. The final products obtained are in the form of multi-row packages comprising foil-encased pots or containers.

The above-described apparatuses are not suitable for joining substantially stiff, sleeve-like packaging carriers, as are disclosed for example in DE-OS (German laid-open application) No. 30 29 047, to cup-like containers, in a sample and inexpensive manner. The sleeve-like packaging carriers comprise a carrier plate or panel having two strip portions flanking the carrier plate, and a cover plate or panel which is connected to the carrier plate or panel by means of the side edge strips, to form a square or rectangular sleeve cross-section. The carrier panel is provided with openings into which the upper portion of a respective container, which has an edge collar or flange portion, is fitted, until the collar or flange portion engages behind the marginal portions of the respective opening, whereby it is clampingly held in position. In that clamped position, the above-mentioned edge strip portions, with strip-like regions of the carrier panel, form marginal beads or edge configurations, the cross-sections of which substantially form isosceles triangles. The edge configurations or marginal beads are joined together by transverse strip portions which in turn provide edge portions for the openings.

Such units comprising the sleeve-like packaging carrier and containers which are clampingly held in the openings therein, in particular yogurt containers, have already proved themselves to be successful under practical conditions of use, but hitherto still had to be fitted together in a comparatively expensive manner.

SUMMARY OF THE INVENTION

Having regard to the foregoing considerations, the object set by the present inventor was that of providing an apparatus of the general kind set forth in the opening part of this specification, such that the above-described packaging unit comprising a stiff packaging carrier and cup-like containers or vessels which are held thereby at one end can be put together by machine, the invention seeking to provide both a high through-put capacity and also the capability of adaptation to different sizes and quantities or groups of containers.

That object is achieved in that at least one holder means which temporarily receives the containers intended for a packaging carrier from the conveyor member is disposed movably above the conveyor member, the substantially horizontal path of movement of the holder means extending between an array of pressure members and abutment members that is disposed downstream of the packaging carrier guide means and forms a pressing station, and downstream thereof being disposed in tangential or touching relationship to a discharge conveyor for taking away the packaging unit comprising the packaging carrier and the containers suspended therefrom, which is produced in the pressing station.

It has been found particularly desirable for both the operation of feeding the containers and also the operation of removing the packaging unit to be performed by a single conveyor member which engages under the path of movement of the holder means.

In accordance with a further feature of the invention, the holder means comprises a pair of parallel rods or bars, said pair projecting substantially radially from a vertical shaft and forming lateral support skids or runners for a respective row of cup-like containers which are held therebetween. In another embodiment, provided on said rods or bars are shaped strip members acting as separate support skids or runners, which, in accordance with the invention, are capable of being adjusted relative to each other in respect of inclination and/or spacing. That permits the arrangement to be adapted to the respective container or container contours.

The parallel bars or support skids or runners laterally define a holding or guide track and between them receive the pots or containers which are introduced into the guide track by the conveyor belt, in such a way that the containers are free both in the region of their bottom portion and also in the region of their cover portion, and can be guided around the shaft to the array of pressure members and abutment members, forming a connecting station. In accordance with the invention, in order to facilitate lifting the bottoms of the containers from the conveyor belt, the latter may be provided with a support means, or may be so arranged, that the lower edges of the containers are disposed in the region of the support skid or runner feed means above machine components surrounding the conveyor belt, and thus can be carried away above such components.

The number of containers or pots on the holder means is preferably determined by at least one adjustable abutment which delimits the guide track for the pots, towards the shaft, and which is possibly carried on a central rotary disc or plate from which, in accordance with another feature of the invention, the pairs of bars or support skids radially project. If the free ends of each two adjacent bars of juxtaposed holder means are joined by connecting bars on corresponding transverse members, that arrangement provides, in accordance with the invention, a turntable which can be suspended on a machine frame structure, above the conveyor member, freely movable relative thereto, possibly on a transmission means which is secured to the machine frame structure.

The invention also provides that the pressure members are disposed below the turntable which determines the path of movement of the containers, while the abutment members of a pressure station formed by the array are arranged above the path of movement.

It has been found advantageous for the abutment members to be secured to pressure plates or discs of an abutment drum which is rotatable about a shaft that is parallel to the path of movement, wherein associated with the periphery of the drum is the mouth opening of a channel-like, inclined chute; the chute forms the guide means for the sleeve-like packaging carriers which slide down to the drum in the chute, while in a flat condition of bearing against each other, being cyclically fed individually to the abutment members.

In accordance with the invention, the abutment or support members are U-shaped members, of which a plurality, being in a mutually aligned position, form a series or row for receiving a packaging carrier which, as will be appreciated, then bears against the abutment drum, in a condition of being parallel to the axis of the drum. In addition, the abutment members are fixed to be pressure discs in flattened portions of the periphery thereof, as the base or support web portion of the shaped members forms a plane and would thus not hold to a curved peripheral portion.

A plurality of such rows of abutment members are distributed over the periphery of the drum at the same angular spacings, whereby the packaging carriers can be cyclically lifted from the guide means, subsequently additionally pressed firm in a second station, and applied to a respective row of pots or containers in a further station. That sequence of movements occurs when using an abutment drum having three rows of abutment members thereon, and it will be appreciated that more than three such rows may also be distributed at the periphery of the drum.

In order to promote the draw-in operation in respect of the sleeve-like packaging carriers, air holes or ducts open at the interior of at least some of the abutment members, the air ducts or holes being connected to an air supply system of the drum and either sucking the packaging sleeve into position by virtue of generating a reduced pressure, or promoting and assisting with ejection of the packaging sleeve, by blowing the air out of the mouth openings. It is in accordance with the present invention, in the course of rotation of the drum, firstly to generate a reduced pressure and then to produce the discharge flow. However, the choice of air supply means depends on the respective requirements concerned.

In addition, a force storage means may be provided on at least one abutment member of a row thereof, for temporarily pressing against a packaging sleeve in the fitted condition. The force storage means may be provided in addition to or instead of the above-described air system, preferably being in the form of a leaf or blade spring which is secured to the tip of a limb of a shaped member and which projects with a free spring arm into the interior of the abutment member. The spring should not represent an obstacle or impediment upon insertion of the packaging sleeve, but on the other hand should provide sufficient support during the rotary movement of the drum shaft, more specifically, until the moment at which the packaging sleeve is joined to the pots or containers, as is still to be described.

At its periphery, the drum is provided with peripheral grooves or slots of substantial width, which are preferably produced by intermediate discs which are respectively secured between each two pressure discs, being of smaller radius than same. The pressure discs and the intermediate discs are fixedly joined together by pin or bolt members which extend parallel to the axis thereof, and they carry the above-described air system which, in accordance with the invention, communicates with stationary air pipes in the region of an end disc of the rotatable drum.

The above-described peripheral grooves or slots of the drum, or at least some thereof, permit a movement which is substantially radial with respect to the shaft of the drum, in respect of a lever arm which is limitedly pivotal about an axis, and therewith a suction head which is secured to the end of the lever arm. The suction head is movable between the drum and the mouth of the guide means for the packaging sleeves. By means of the suction head which is connected to the reduced-pressure system, possibly by way of lever arm and axis, a packaging sleeve is picked up at the mouth of the guide chute and introduced into a row of abutment members disposed opposite the mouth. As the suction head then engages the outward side of the cover plate or panel of the packaging sleeve, the function of the above-described slot or groove is clear—after introduction of the packaging sleeve into the row of abutment members, the suction head must also be moved into a position at a spacing, even if slight, from the packaging sleeve.

A kind of hammer means is associated with the periphery of the drum, at an angular spacing from the suction head, which corresponds to the angular spacing of two rows of abutment members. The hammer means is also rotatable about an axis which is disposed at a spacing from the periphery of the drum and outwardly thereof.

In accordance with the invention, the hammer head of the hammer-like pressure element reaches a row of abutment members when the next following row in the direction of rotary movement is disposed in the region of the suction head.

The purpose of the pressure element is correctly to position the packaging sleeve which is introduced by the suction head, in the row of abutment members, and to press it against the configuration of the abutment member. The pressure element is obviously only intended as an auxiliary aid or accessory, and is not a necessary part of the apparatus according to the invention.

The drum shaft of the above-described drum is disposed in the vertical plane through the above-mentioned pressure members which are disposed below the horizontal plane of movement of the holder means and preferably comprise a horizontal pressure table on vertically movable lift columns. In the rest condition, the table is disposed below the path of movement of the containers which stop thereabove for the actual connection operation, in the circular movement, and which, upon actuation of the lift columns, are guided by the pressure table towards the packaging sleeve which has arrived at a position above them.

For the purposes of improved fixing of the containers or pots, the vertically liftable pressure table may be provided with spacer bar members which define the horizontal radial spacing between the bottoms of the containers and which taper in the direction of rotation of the turntable.

The same purpose may be served by alternative or additional edge bar portions of the pressure table, the mutual spacing thereof corresponding to the diameter of the bottom of the containers. Although most pots or containers are already in accordance with prescribed standards, so that there is probably no longer any need for the parts of the machine to be adapted to given diameters of containers, the pressure table in accordance with the invention can be released from its lift columns, and can thus be exchanged.

The lift columns respectively co-operate with an eccentric cam of an eccentric shaft which extends below the columns. The eccentric cams provide for cyclic lifting movement of the columns and thus the pressure table. The lift columns are returned by force storage means, preferably coil springs which extend around the columns and which are disposed between a machine frame structure and a bottom abutment collar or flange on the lift column.

With the stroke movement of the pressure table, the row of pots which are disposed thereabove is lifted out of its holder means and pressed into the packaging sleeve which is disposed thereabove, against the downward portion of the periphery of the drum, until the packaging sleeve engages with a clipping action under the edges of the containers. The turntable then continues to rotate until the packaging unit which has just been formed can be engaged by and removed by the conveyor belt loop.

The apparatus according to the invention is also distinguished in that both the drive transmission for the turntable and also the eccentric shaft of the lift column assembly are connected to a common drive means, the drive shaft for the turntable extending coaxially with respect to the shaft of the drum and also driving same. The central drive means even provides for actuation, by way of an interposed transmission, of the two shafts for the suction heads on the one hand and the pressure elements on the other hand.

All the rotary movements of the apparatus are derived from a central drive means at one end of the machine by a chain or belt drive which, by means of a rocker arm or link, also provides a friction drive for the horizontal moving conveyor belt loop. In that way, the individual stations of the machine can be accurately matched by suitble choice in respect of the coupling means and transmission components. In that way it is readily possible for the method steps described to be performed cyclically in the correct interlocking fashion.

In all, the invention provides a compact apparatus for assembling the sleeve-like packaging carriers to their containers or pots, thereby impressively attaining the object set by the inventor.

DESCRIPTION OF THE PREFERRED EMBODIMENTS

Figure 1:
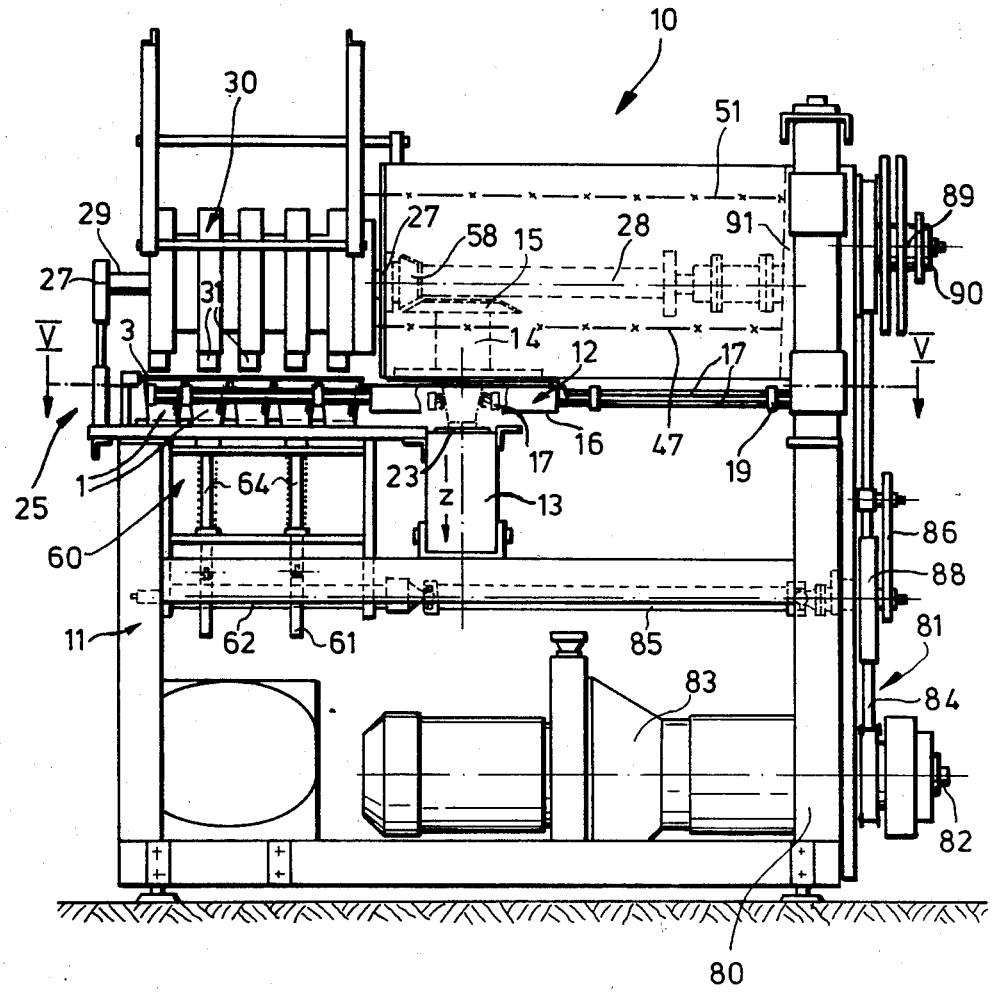
FIG. 1 shows a side view of an apparatus according to the invention for fitting together a plurality of cup-like containers by means of a sleeve-like packaging carrier.

Further advantages, features and details of the invention will be apparent from the following description of preferred embodiments and with reference to the drawings in which:

A packaging apparatus 10 for securing yogurt pots or cups 1 or like containers, having an edge collar or flange portion 2, to a sleeve-like carrier 3 comprising a paper or cardboard blank, comprises, on a machine frame structure 11, underneath a disc-like turntable 12, an endless conveyor belt loop 13 which moves in the conveying direction z below the turntable 12 and diamtrally relative thereto about guide rollers 50 (not shown in further detail).

Figure 3:
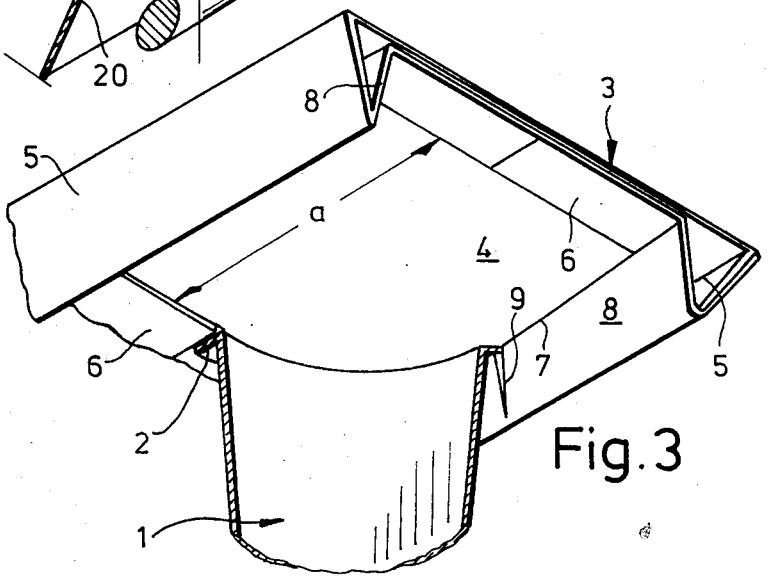
FIG. 3 shows a partly sectional detail on an enlarged scale from FIG. 2.

The carrier sleeve 3 comprises a cover panel or plate 4 and lateral edge bead portions 5 of triangular cross-section which, as shown in FIG. 3, are connected by transverse web portions 6. The upper edges 7 of the two inner limbs 8 of the bead portions 5, in the holding condition, engage under the collar portion 2 of the respective container 1 which is thereby held to the plate or panel 4. In order to increase the elasticity of the inner limbs 8, they are each provided with a respective expansion cut 9 at the centre of the spacing a of for example 55 mm between the transverse bar portions 6.

Figure 4:
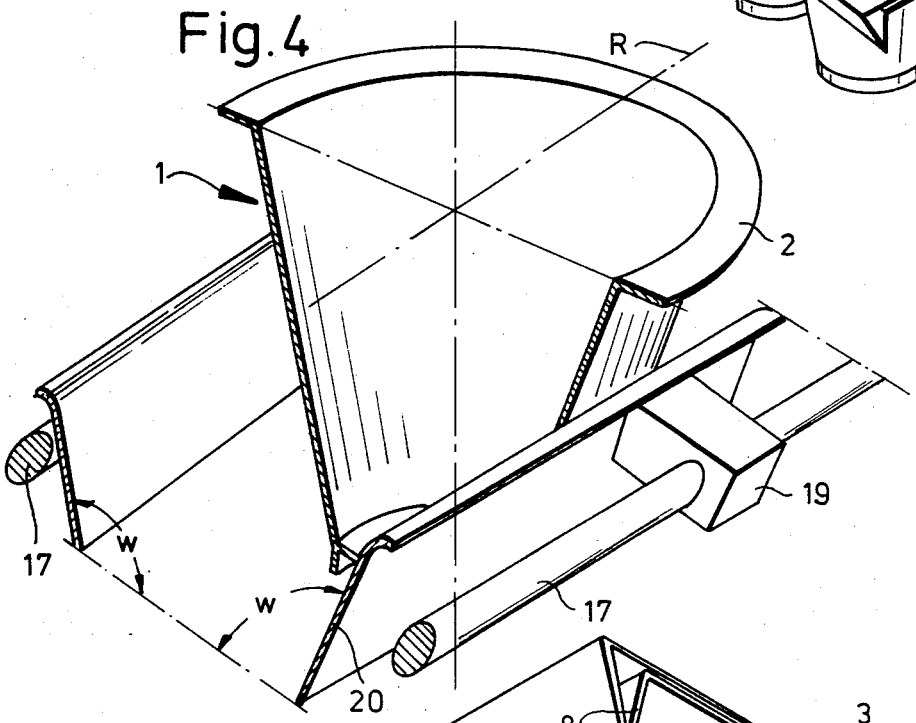
FIG. 4 shows a perspective view on an enlarged scale of a partly sectional detail of FIG. 1.
Figure 5:
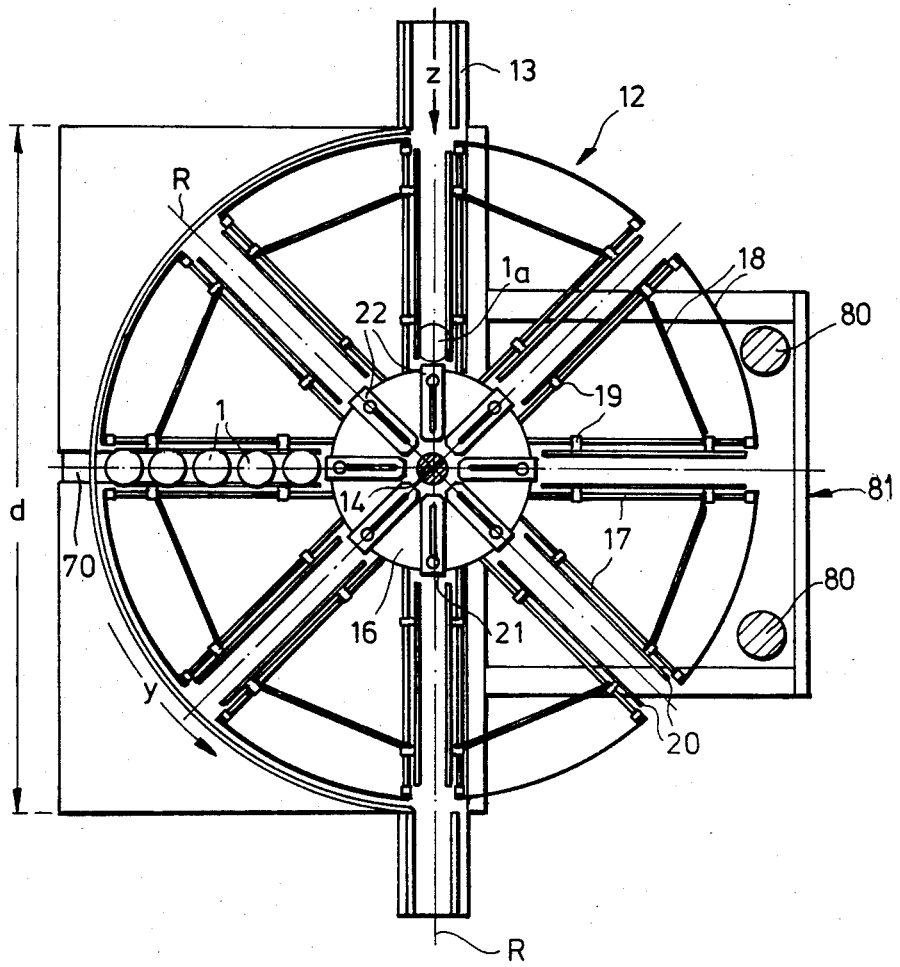
FIG. 5 shows a plan view of a part of the FIG. 1 structure, taken in section along line V—V therein.
Figure 6:
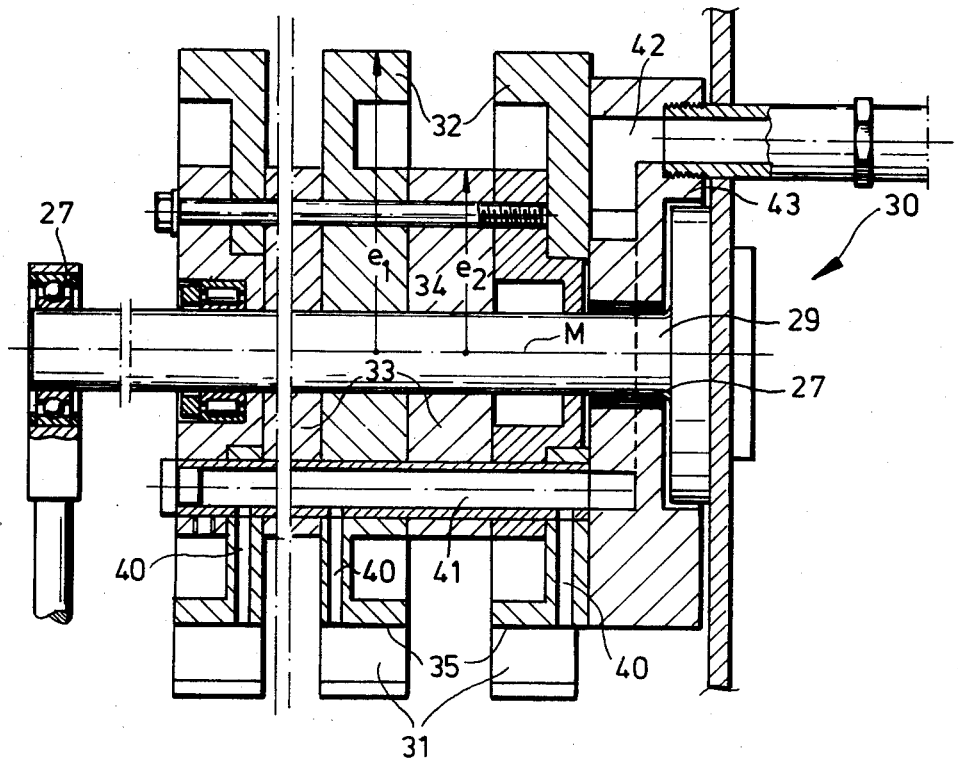
FIG. 6 shows a view on an enlarged scale and partly in section of a drum-like machine component of the FIG. 1 apparatus.

The diameter of the turntable 12 is about 1150 mm. A central rotary disc 16 is suspended on a truncated shaft portion 14 having an upwardly tapering bevel gear 15. The machine components required for suspending the bevel gear 15 and the rotary disc 16 are not shown in the drawing, for the sake of enhanced clarity thereof. Side bars or rods 17 project from the rotary disc 16 on both sides of eight radial axes R. At their free ends, the bars or rods 17 are connected by chord bars or rods 18 which are arranged in an annular configuration and they serve as carriers for support skids or runners 20 which are secured thereto by bar portions 19. The cross-section of the skids or runners 20 is inclined relative to the horizontal at an angle w of about 100°, as can be seen from FIG. 4, and therefore extends parallel to the wall of the container or pot which is also inclined, so that a pair of support runner 20 can hold clampingly between them a container (1*a* in FIG. 5) which is introduced in the direction z, when the container has reached its desired end position, by virtue of the possibly bevelled or chamferred stop edge 21 of a radially adjustable retardation bar member 22. The subsequent containers 1 are then stopped by the respectively preceding container 1.

Figure 2:
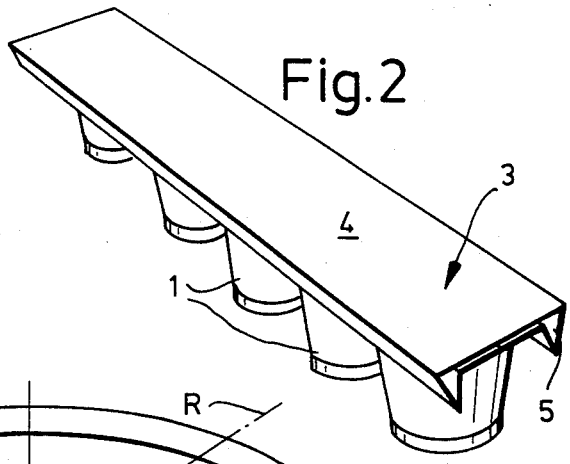
FIG. 2 shows a perspective view of a row of interconnected containers.

The extent by which the bar member 22 projects beyond the rotary disc 16 determines the number of containers 1 which are engaged in a respective group between the pairs of support runners 20 and which are to be secured together to the carrier sleeve. In the illustrated embodiment, it will be seen that the groups comprise five containers 1 (see FIG. 2).

When, by means of a pair of support runners 20, the turntable 12 hs received a number of containers 1, that number being determined by the corresponding retardation bar member 22, from the conveyor belt loop or conveyor belt 13, the turntable is rotated by the shaft portion 14 in the direction indicated by the arrow y until the containers 1 pass into a pressure station 25 which is perpendicular to the direction of the conveyor belt. In order to facilitate lifting the conveyors 1 from the conveyor belt 13, it may be provided with a raised support means 23, on its longitudinal axis.

In the pressure station 25, the containers 1 and the carrier sleeve 3 are brought together. For that reason, close to feed chute 26 for the carrier sleeves 3, the station 25 is provided with an abutment or support drum 30 having gripping means 31 for the carrier sleeve 3, the drum being on a drum shaft 29 which rests in mounting 27 and which is coaxially connected to a horizontal drive shaft 28. The drum 30 is formed by pressure discs 32, of which there are five in the illustrated embodiment, of a radius $e_1$ of for example 130 mm, four intermediate discs 33 with a radius $e_2$ of about 80 mm, and with tie pins or bolt 34 which are parallel to the axis of the shaft.

Figure 7:
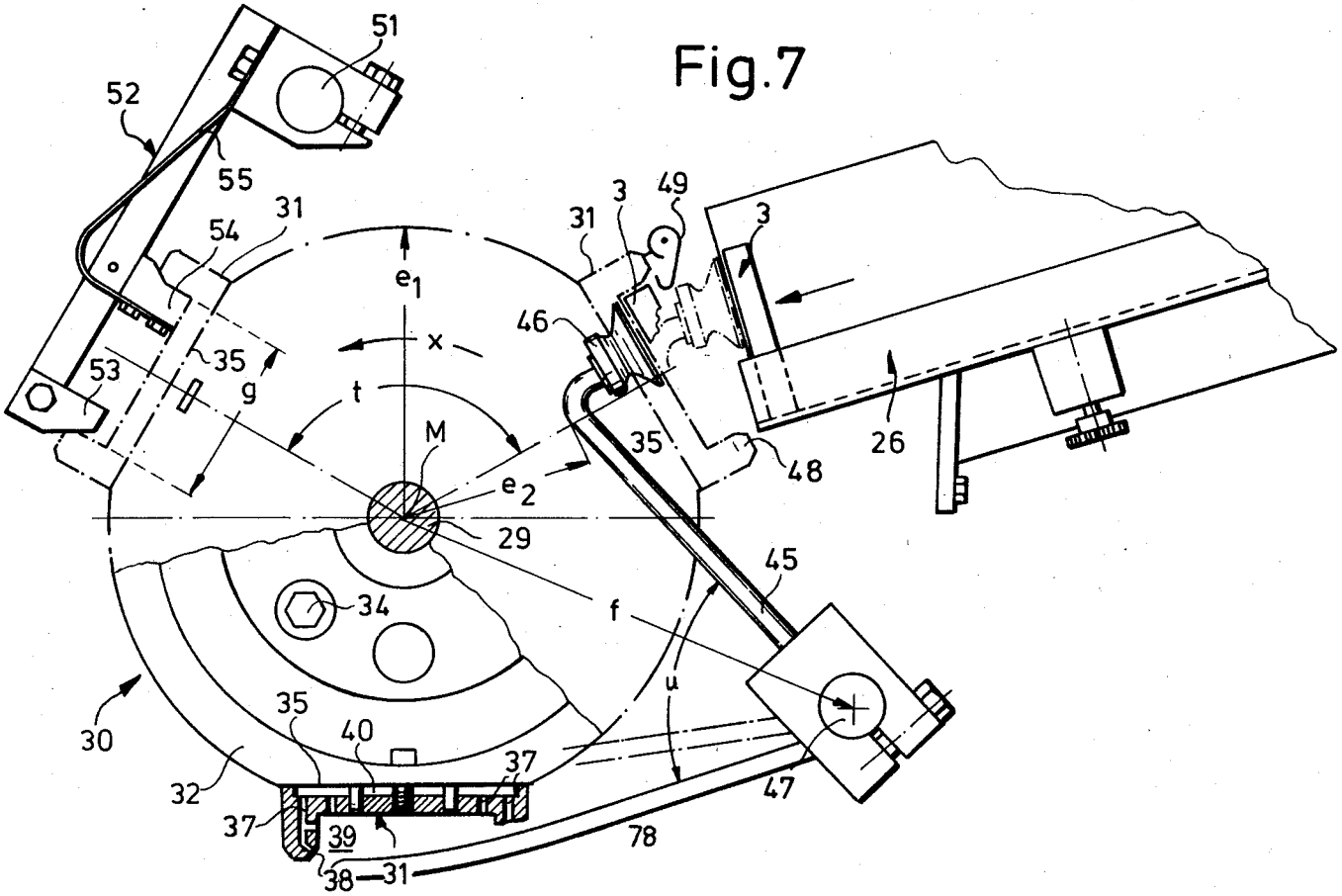
FIG. 7 shows an axial diagrammatic view of a step in the method, with the machine component illustrated in FIG. 6.
Figure 8:
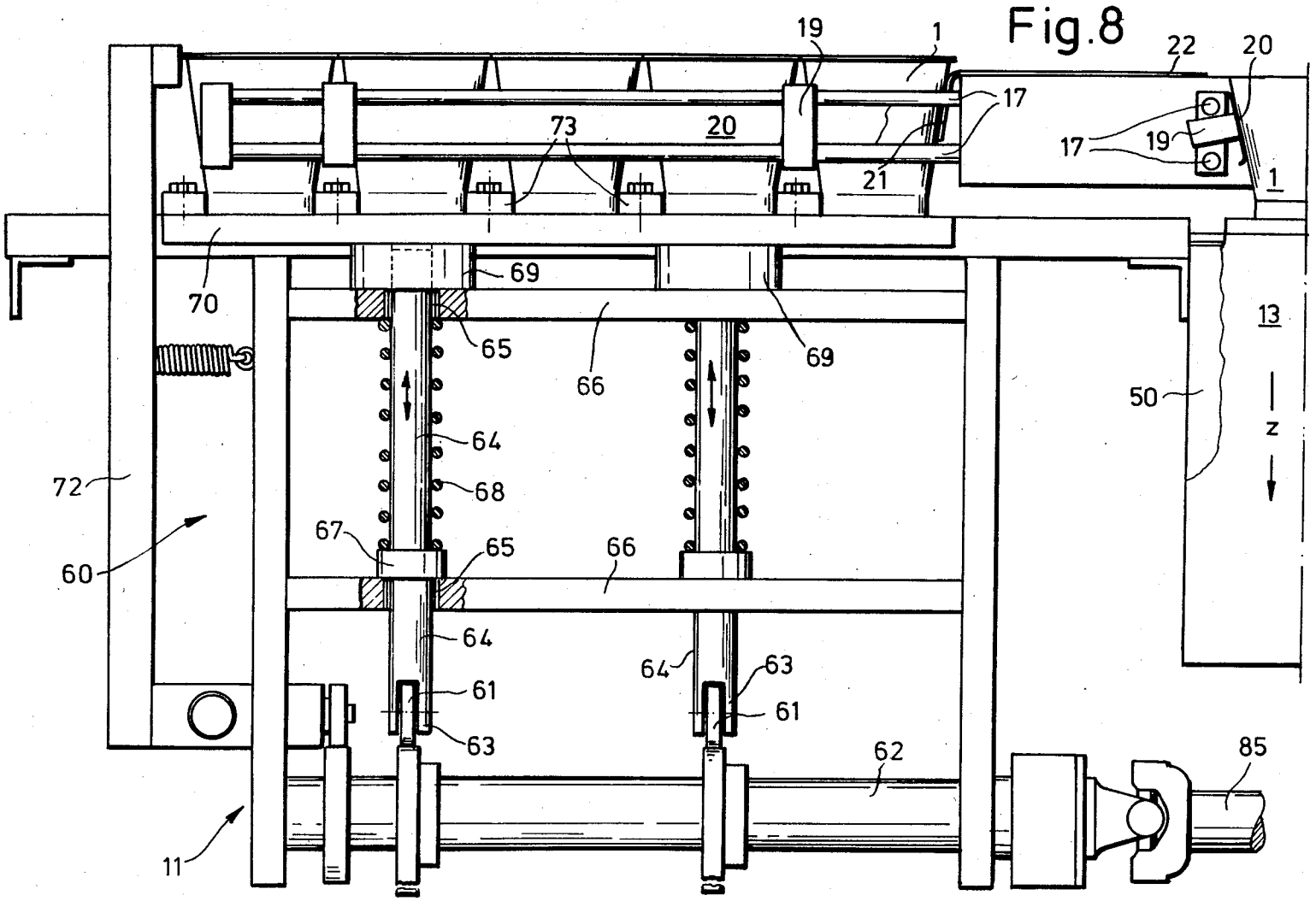
FIG. 8 shows a view on an enlarged scale of another part of the apparatus shown in FIG. 1.
Figure 9:
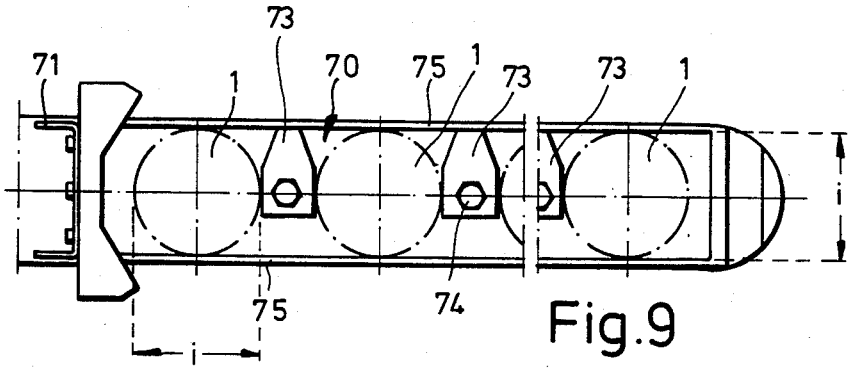
FIG. 9 shows a plan view on an enlarged scale of a part of the FIG. 5 structure.

FIG. 7 more particularly shows three flattened peripheral portions 35 on the pressure discs 32, the portions 35 being displaced relative to each other at angles t of 120°. By means of the flattened portions 35, the gripping means 31, in the form of narrow U-shaped members, can be secured in position without any difficulty. The latter are provided with air bores or ducts 37 which open at 38 into the interior 39 of the U-shaped members 31 and on the other hand are connected by way of air supply passages or ducts 40 to air passages or ducts 41 which extend parallel to the shaft 29 of the drum. The air ducts 41 terminate at an annular space or chamber 42 provided by a stator disc 43.

Disposed opposite the feed chute 26, between the pressure discs 32, are suction levers 45 having suction head 46, being limitedly rotatable about an axis 47 (dash-dotted lines in FIG. 7). The shaft 47 is mounted at a spacing f of about 200 mm from the main axis M of the drum 30.

A respective carrier sleeve 3 is taken from the feed chute 26 by the suction head 46 which is connected to an air supply means (not shown), possibly by way of the shaft 47 which is then in the form of a hallow shaft, and drawn parallel to the shaft 29 of the drum into the interior of the U-shaped member 31. Spring elements 49 which are possibly provided at the tips 48 of the limb portions of the U-shaped member prevent the inserted carrier sleeve 3 from arbitrarily slipping out in the even of a drop in pressure or the like, without the spring elements 49 impeding the described operation of inserting the carrier sleeves 3. In addition, that is promoted by a pulling suction force which can be generated at the air ducts 37 of the U-shaped members 31.

After the drum 30 has rotated through the angle t, the U-shaped member 31 and therewith the carrier sleeve 3 pass into the operative region of pressure elements 52 which are pivotable for limiting pivoting movement about an axis 51 in a hammer-like mode. At the end of a shank portion, the elements 52 comprise a fixed cam 53 and, at a spacing therefrom, on a leaf or blade spring 55, an adjustable cam 54, the spacing of which cams from each other is variable and can thus be adapted to the cross-section of the carrier sleeve 3. The cams 53 and 54 press with their outward surfaces against the carrier sleeve 3 in such a way that it takes up the desired shape in which it conforms to and bears against the U-shaped member 31, the rectangular cross-section of the sleeve being deformed in such a way as to give the edge bead portions 5 which can be clearly seen in particular from FIG. 3.

Just for the sake of completeness, it should be noted here that the width g of the interior 39 of the shaped member can also be altered; either the base portion of the U-shaped member 31 itself is variable in size, in a direction transverse with respect to the longitudinal axis of the U-shaped member, or the ease of fitting of the U-shaped member 31 to the discs 32 permits rapid exchange thereof, for altering the size of the component.

After a further rotary movement of the drum 30 about its main axis M in the direction indicated by the arrow x, the U-shaped member 31 together with the carrier sleeve 3 carried thereby faces downwardly on to the containers 1 which are disposed therebelow in a line on the pair of support bars 20.

Like the rotary movement of the turntable 12, the above-described rotary movement of the drum is a cyclic movement and is taken from the drive shaft 28, the horizontal bevel gear 58 of which also drives the bevel gear 15 of the turntable 12.

In the pressing station 25, the containers 1 are guided upwardly to the carrier sleeve 3 which has arrived at that position, by means of a lift device 60, more specifically, by eccentric cams 61 on a lift shaft 62.

The eccentric cams 61 are operatively connected to the fork ends 63 of two lift columns 64; the latter run in guide openings 65 in support frame bar members 66. Coil springs 68 are disposed between one of the members 66 and collar portions 67 on the lift columns 64, to act as return force storage means for the lift columns 64. The upper ends thereof are disposed in head plates 69 which in turn are connected to a narrow pressing table 70 of the station 25; the table 70 is guided inter alia by an end yoke member 71 between vertical bars on rods 72 of the support frame structure.

For the purposes of temporarily fixing the containers 1 on the table 70, spacer blocks 73 are releasably and adjustably connected by screws 74 to the table 70. The mutual spacings of the spacer members 73 coresponds to the diameter i of the base of the container.

It is also possible for the arrangement to have lateral table edge portions 75 at a spacing i from each other, to act as guide means.

By virtue of the table 70, the containers 1 which are hanging loosely between the pairs of support runners 20 can be pressed against the U-shaped member 31 which is disposed thereabove, until the edge collar portions 2 snap into position behind the inward limbs 8 of the bead portions of the carrier sleeve 3; the U-shaped member 31 is then vented, and the carrier sleeve 3 is moved downwardly and, with the containers 1, is conveyed away by the pair of support runners 20, in the direction y, about the shaft portion 14. As soon as the containers 1 have reached the discharge side of the conveyor belt 13, they are engaged and discharged thereby.

In principle, three conveyor slots formed by the pairs of support bars 20 in the turntable 12 are sufficient for the cyclic packing of the containers 1, as in that case the operation of introducing the containers 1 between a pair of support bars 20, the operation of connecting same to the carrier sleeve in the region of the second pair of support bars 20 and the discharge operation at the third pair of support bars 20 can be effected simultaneously. The illustrated embodiment of the turntable 12 with eight pairs of support bars 20 permits versatile variation both in regard to the containers 1, and thus the sizes of carrier sleeves, and also in regard to the number of containers in each packaging group.

Both the upper horizontal drive shaft 28 for the turntable 12 and the drum 30, and also the eccentric shaft 62 which extends below the lift columns 64, are taken to a drive side 81 defined by two upright columns 80. The interposed coupling members are not shown specifically in the drawings, as they can be freely selected.

Figure 10:
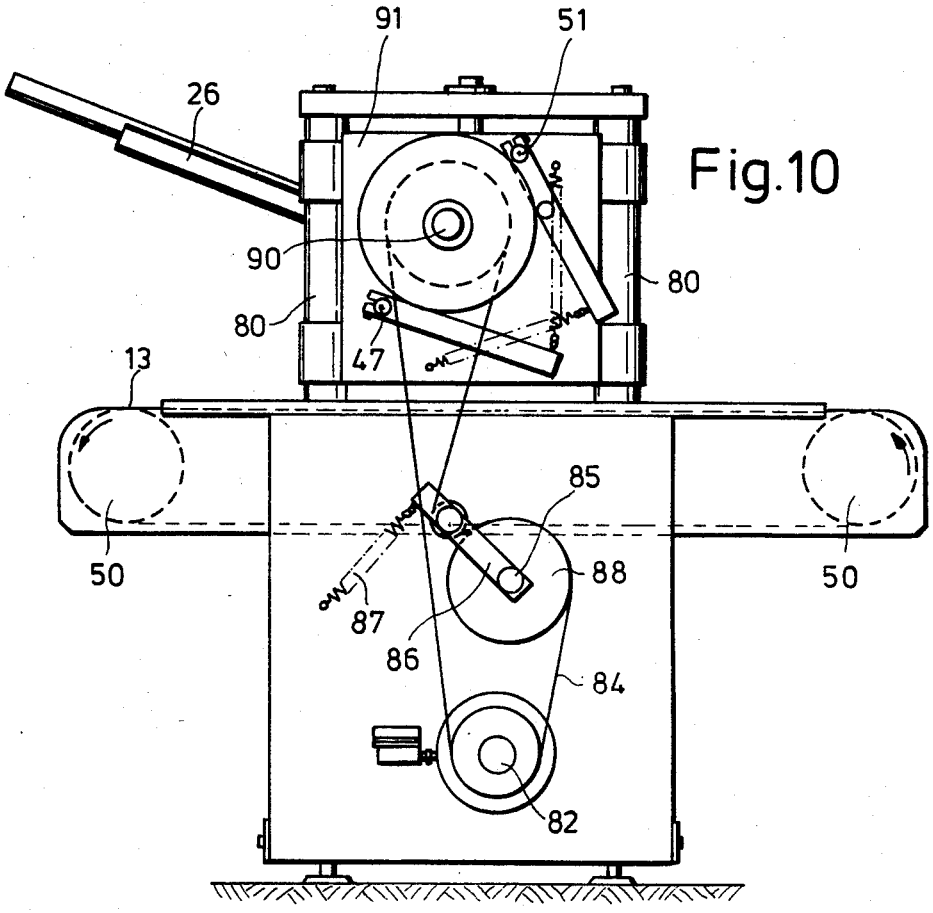
FIG. 10 shows a front view of the apparatus shown in FIG. 1.

As shown in FIGS. 1 and 10, the shaft 82 of a central drive means 83 drives, by way of a drive run 84, on the one hand a chain drum or a belt pulley 88 of a cardan shaft 85 which connects to the eccentric shaft 62, with tensioning rocker arm 86 and force storage means 87, and on the other hand, a pulley 89 on a shaft portion 90 of a transmission means in a transmission casing 91; that transmission means actuates both the upper drive shaft 28 and also the shafts 47 and 51, which are only indicated in FIG. 1, of the suction lever 45 or the pressure element or spreading hammer 52 respectively.

By virtue of using a central drive means 83, it is possible centrally to adjust the desired operating cycle, and there is no need for a plurality of control installations.

The compressed air components required for pulling in and securing the carrier sleeve 3 on the rotating drum 30 are only partly shown in the drawings but, as described above, include conduit spaces in hollow shafts, and are connected to a compressor (not shown).

In FIG. 7, reference numeral 78 denotes a lever arm which is moved synchronously with the suction head 46 on the spindle or shaft 47. The lever arms 78 rest, in the rest position shown in broken lines, between the discs 32, above the plane for the carrier sleeve 3 and, in the operative position shown in solid lines, press the carrier sleeve 3 out of the space 39. The angle u between the leverarm 78 and the suction lever 45 is so adjusted that the lever arm 78 is in the rest position, when the suction head 46 is in the suction position.

What I claim is:

1. An apparatus for fitting and engaging cup-like containers in packaging carriers comprising:

indexing means for moving said cup-like containers from a first station wherein said containers are associated with said indexing means to a second station wherein said containers are fitted and engaged in said packaging carriers to a third station wherein said packaging carriers with containers are disassociated with said indexing means; conveyor means for feeding said containers to said indexing means at said first station and removing said packaging carriers with containers from said indexing means at said third station; and means associated with said second station for feeding and fixing said packaging carriers to said containers and said second station.

2. An apparatus according to claim 1 wherein said indexing means is disposed above said conveyor means and is movable along a substantially horizontal path from station-to-station.

3. An apparatus according to claim 2 wherein said indexing means comprises a rotating turntable provided with receptable means for receiving said containers.

4. An apparatus according to claim 3 wherein said means associated with said second station for feeding and fixing said package carriers to said containers includes abutment means and pressure means wherein said abutment means and pressure means are spaced apart from each other so as to define a space through which said turntable rotates.

5. An apparatus according to claim 4 wherein said means associated with said second station further includes means for feeding packaging carriers to said abutment means.

6. An apparatus according to claim 3 wherein said receptacle means comprises a pair of substantially parallel spaced apart rods radiating from the center of said rotating turntable, said rods each carrying a support skid for supporting a container therebetween.

7. An apparatus according to claim 6 wherein said support skids are adjustable on said rod.

8. An apparatus according to claim 3 wherein said turntable is suspended from a drive shaft below a drive transmission means.

9. An apparatus according to claim 3 wherein said turntable is provided with a plurality of recepticle means.

10. An apparatus according to claim 4 wherein said abutment means are U-shaped and are mounted on a rotatable drum above said pressure means.

11. An apparatus according to claim 10 wherein pressure discs are mounted on said rotatable drum and said abutment means are secured to said pressure discs.

12. An apparatus according to claim 11 wherein said abutment members are arranged at the same angular spacings (t) on the periphery of said drum.

13. An apparatus according to claim 10 including means for adjusting the width of at least one of said U-shaped abutment members and wherein said at least on abutment member is provided with air bores at the interior thereof, said air bores communicating with an air duct system.

14. An apparatus according to claim 13 including means provided on said at least one U-shaped abutment member at the tip of at least one limb portion of the U-shape and projecting into the interior of said abutment member.

15. An apparatus according to claim 10 wherein intermediate discs are provided between said pressure discs, said intermediate discs are smaller in diameter than said pressure discs so as to define a space between adjacent abutment means, said pressure discs and said intermediate discs have a plurality of bores and air ducts connecting same to an air duct system.

16. An apparatus according to claim 15 wherein a pivotable lever arm having a suction head is associated with at least one of the spaces between the abutment means.

17. An apparatus according to claim 11 including lever arm means positioned between the pressure discs for pressing said packaging carrier out of the abutment member.

18. An apparatus according to claim 13 wherein a head of a pressing element is associated with the periphery of the drum, the shank of said pressing element being secured to an axis member which extends at a spacing from the periphery of the drum and parallel thereto.

19. An apparatus according to claim 18 wherein the head of the element has two jaws, each of which is associated with the inward edge of a limb portion of said abutment member, such that the spacing of the jaws is variable.

20. An apparatus according to claim 4 wherein said pressure means includes lift members which extend in a vertical plane defined by the horizontal path of said indexing means, said lift member comprising a horizontally extending, vertically liftable pressure table on lift columns.

21. An apparatus according to claim 20 including spacer bar portions provided on the pressure table, said spacer bar portions determine the horizontal radial spacing of the container bottoms and which taper towards the direction of rotation of the turntable.

22. An apparatus according to claim 20 wherein the lift columns respectively cooperate with an eccentric cam on an eccentric shaft which extends below the columns, said columns being mounted liftably against the force of a coil spring which extends between the machine frame means and an abutment collar on the lift column.

* * * * *